US005202002A

United States Patent [19]

Tsuchinaga et al.

[11] Patent Number: 5,202,002

[45] Date of Patent: Apr. 13, 1993

[54] PROCESS FOR PICKLING STEEL-BASED METALLIC MATERIALS AT A HIGH SPEED

[75] Inventors: Masamitsu Tsuchinaga; Seizaburo Abe, both of Kitakyushu, Japan

[73] Assignee: Nippon Steel Corporation, Tokyo, Japan

[21] Appl. No.: 882,498

[22] Filed: May 13, 1992

[30] Foreign Application Priority Data

May 14, 1991 [JP] Japan ..... 3-109265

[51] Int. Cl.[5] ..... C25F 1/06

[52] U.S. Cl. ..... 204/145 R

[58] Field of Search ..... 204/145 R

[56] References Cited

U.S. PATENT DOCUMENTS 3,694,334 9/1972 Bombara ..... 204/145

FOREIGN PATENT DOCUMENTS 0129194 12/1984 European Pat. Off. .
0209168 1/1987 European Pat. Off. .
59-83783 5/1984 Japan .
64-288 1/1989 Japan .

OTHER PUBLICATIONS

Patent Abstracts of Japan, vol. 8, No. 41, (C-211) (1478) Feb. 22, 1984.
European Search Report EP 92 10 8061.
Patent Abstracts of Japan, vol. 9, No. 41, (C-267) (1764), Feb. 21, 1985.

*Primary Examiner*—T. M. Tufariello
*Attorney, Agent, or Firm*—Kenyon & Kenyon

[57] ABSTRACT

A process of pickling surfaces of a steel-based metallic material containing iron, carbon and chromium at a high speed wherein the surfaces of the metallic material are pickled at a high speed by dipping and then pickling the surfaces of the metallic material in an aqueous solution of hydrochloric acid or an aqueous solution of hydrochloric acid-nitric acid mixture while at least one kind of ion selected from a group comprising a platinum ion, a palladium ion and a rhodium ion is contained in a hydrochloric acid having a temperature of 50° to 110° C. and a concentration of 100 to 450 g/l with $NO_3^-$ ion contained therein by a quantity of 300 g/l or less, as desired, or pickling treatment in the aforementioned aqueous solution by feeding a direct current between two electrodes at an electric current density of 5 to 200 A/Dm$^2$, one of the electrodes being an anode composed of the metallic material and the other one being a cathode electrode disposed opposite to the anode, or an anode and a cathode comprising one pair of electrode plates disposed at both sides of a surface of the metallic in the aqueous solution, and feeding a direct current between the anode and the cathode at an electric current density of 5 to 200 A/Dm$^2$, to thereby dissolve off a scale formed on the surface of the metallic material in the aqueous solution by an indirect feeding of the direct current.

12 Claims, 5 Drawing Sheets

PROCESS FOR PICKLING STEEL-BASED METALLIC MATERIALS AT A HIGH SPEED

BACKGROUND OF THE INVENTION

1. Field of the Invention

The present invention relates to a process of pickling oxide (scale) formed on the surface of a steel-based metallic materials such as carbon steels, low-alloy steels containing a small amount of a softening/hardening elements such as chromium, nickel, niobium, or special steels containing a large amount of chromium, nickel, or the like.

2. Description of the Prior Art

In general, a strip of steel-based metallic material such as carbon steels, low-alloy steels, special steels, or the like, has been hitherto produced by way of the following steps. First, the strip of metallic material is subjected to mechanical descaling treatment such as shot blasting or the like, to remove scale formed on the surfaces of the strip which is hot-rolled or is annealed after hot-rolling. Subsequently, the strip is subjected to a chemical descaling treatment, i.e., pickling treatment, to achieve a complete removal of the scale therefrom, and thereafter, is cold-rolled.

To perform a pickling treatment, a specific kind of aqueous solution has been heretofore selected dependent on the kind of steel to be treated. For example, in a case where a strip of austenitic stainless steel containing nickel is pickled, an aqueous solution of a nitric acid-hydrofluoric acid mixture is employed for the steel strip. However, since a pickling ability of the aqueous solution of the nitric acid-hydrofluoric acid mixture is degraded according to an increase in chromium content of the steel, there arises a problem of intergranular corrosion of a special steel, such as lowalloy steel, a ferritic stainless steel or the like, produced without any annealing operation or merely with a simplified annealing operation and exhibiting a Cr-depleted zone along the grain boundary.

In view of the aforementioned problem, a pickling treatment is generally performed for special steels such as low-alloy steels, ferritic stainless steels or the like, by employing an aqueous solution of hydrochloric acid or an aqueous solution of sulfuric acid. However, it has been considered that it is difficult to accomplish a complete pickling treatment by using the same complete pickling aqueous solution for steel-based metallic materials, each having a different composition, within the short operating time that has been required from the viewpoint of production on an industrial basis.

In consideration of the aforementioned problems, there are known many articles, each disclosing a process of effectively pickling a steel-based metallic material. For example, an official gazette of Japanese Unexamined Publication Patent (Kokai) No. 59-83783 discloses a process of pickling a strip of steel sheet by way of two steps: first, dipping the steel sheet in an aqueous solution of sulfuric acid to remove scale therefrom by dissolving it in the aqueous solution, and second, dipping the steel sheet in an aqueous solution of nitric acid to remove a dirty substance (smut) adhesively deposited on the surfaces of the steel sheet, and at the same time, maintaining the surfaces of the same in the passive state. However, this process requires a long time until the scale is completely removed from the steel sheet by successively dipping it in the aqueous solutions. In addition, this process has a problem in that intergranular corrosion occurs especially when a steel-based metallic material having the Cr-depleted zone along the grain boundary, as mentioned above, is dipped in an aqueous solution of nitric acid.

An official gazette of Japanese Unexamined Publication Patent (Kokai) No. 64-288 discloses a process of pickling a steel-based metallic material by dipping it in an aqueous solution of sulfuric acid-nitric acid mixture. Since this process has a pickling ability as large as one to five times compared with a case where an aqueous solution of sulfuric acid is employed for pickling treatment, it has the advantage that scale can be removed from the surfaces of the metallic material within a shorter operating time, and moreover, intergranular corrosion does not occur with a steel-based metallic material having the Cr-depleted zone along the grain boundary. However, when the aqueous solution of sulfuric acid-nitric acid mixture is employed for practical pickling treatment, there arises a problem in that a quantity of metallic ion such as an iron ion, a chromium ion or the like increases as a part of the metallic material, dissolved in the aqueous solution, and therefore, the composition and the nature of the aqueous solution vary, resulting in the pickling ability being substantially degraded.

SUMMARY OF THE INVENTION

The present invention has been made with the foregoing background in mind.

An object of the present invention is to provide a process of pickling a steel-based metallic material at a high speed wherein scale formed on the surfaces of the metallic material can be removed therefrom at an improved corrosive scale-removing efficiency.

Another object of the present invention is to provide a process of pickling a steel-based metallic material at a high speed wherein the surfaces of the metallic material exhibit a smoother appearance after completion of the pickling treatment.

According to the present invention, a process for pickling a steel-based metallic material at a high speed is provided, wherein the metallic material is dipped in or subjected to electrolytic treatment in an aqueous solution of hydrochloric acid which contains at least one kind of ion selected from a group comprising a platinum ion, a palladium ion and rhodium ion, in a quantity of 500 mg/l or less in a hydrochloric acid or a hydrochloric acid-nitric acid mixture having a concentration of 100 to 450 g/l, and an ion of $NO_3^-$ in a quantity of 300 g/l or less, if necessary, and of which temperature is elevated to a range of 50 to 110° C.

According to the present invention, since at least one kind of ion selected from a group comprising a platinum ion, a palladium ion and a rhodium ion, is selectively added to the aqueous solution of hydrochloric acidor the aqueous solution of hydrochloric acid-nitric acid mixture, there does not arise the malfunction that a passivation potential appears in the aforementioned aqueous solution, and moreover, there does not arise the malfunction that intergranular corrosion occurs. Thus, advantageous effects obtainable with the process of the present invention are noted below. Specifically, when the steel-based metallic material is loaded with an anode current, the process can exhibit a corrosive scale-removing ability higher than the conventional dipping process. In addition, a corrosion scale-removing quantity can be increased even when an indirect current-feeding process in a non-contact state is administered to the steel-based metallic material. Further, the process can exhibit a high dissolving capability for an austenitic stainless steel which has a low pickling capability in the conventional pickling process.

BRIEF DESCRIPTION OF THE DRAWINGS

The present invention is illustrated in the following drawings in which.

DESCRIPTION OF THE PREFERRED EMBODIMENTS

To carry out the present invention, a hydrochloric acid having a concentration of 100 to 450 g/l is used to prepare an aqueous solution for performing a pickling treatment. The hydrochloric acid is employed as an essential component in view of the advantage of its excellent dissolving capability of a ferrous substrate compared with a sulfuric acid, resulting in the pickling time required for a steel-based metallic material being shortened. Such an advantageous effect of the hydrochloric acid, as mentioned above, is not always obtained at all of the concentration of the aqueous solution. When the hydrochloric acid has a concentration lower than 100 g/l, there arises a problem in that scale formed on the surfaces of the steel-based metallic material is hardly dissolved in the aqueous solution of hydrochloric acid due to shortage of a dissolving capability, causing a long time to elapse until the pickling treatment is completely accomplished. On the contrary, when the hydrochloric acid has a concentration in excess of 450 g/l, the dissolving capability is supersaturated. For this reason, the concentration of the hydrochloric acid is defined to remain within the range of 100 to 450 g/l. In addition, at least one kind of the ion selected from a group comprising a platinum ion, a palladium ion and a rhodium ion is added to the aqueous solution of hydrochloric acid having the above-defined concentration, in a quantity of 500 mg/l or less.

Figure 1:
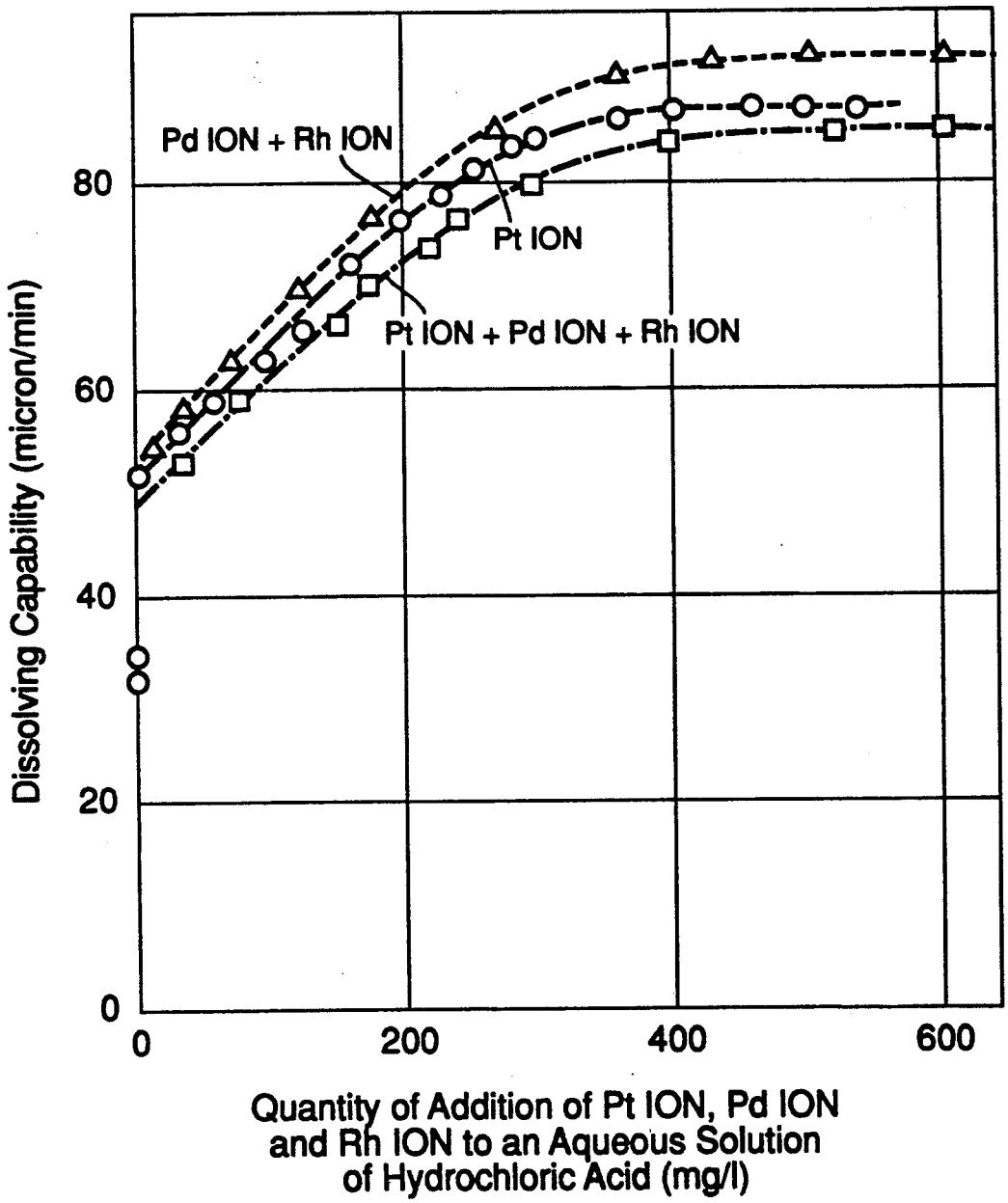
FIG. 1 is a graph which illustrates the dissolving capability of a pickling treatment solution in a case where a steel strip of Type430 is dipped in the pickling treatment solution, prepared as an aqueous solution of hydro-chloric acid, having a platinum ion, a palladium ion and a rhodium ion added thereto.

Advantageous effects obtainable from addition of the platinum ion, the palladium ion and the rhodium ion are as shown in FIG. 1. According to the quantity by which their addition increases, a dissolving quantity from the metallic material increases. In other words, descaling can be accomplished with the metallic material within a short operating time. In addition, when a steel-based metallic material having the Cr-depleted zone along the grain boundary is subjected to a pickling treatment, intergranular corrosion does not occur. Thus, a product of steel-based metallic material having smoothly pickled surfaces can be obtained. Although the metallic material exhibits a dissolving effect with slight ion addition by a quantity of about 1 mg/l, it is recommendable from the viewpoint of a dissolving effect required for production on an industrial basis, that the ions are added to the aqueous solution by a quantity of 3 mg/l or more. However, excessive addition of the ions is not economically acceptable because the dissolving capability is supersaturated. For this reason, the total quantity of additional platinum ions, palladium ions and rhodium ions is defined to be 500 mg/l or less.

Figure 2:
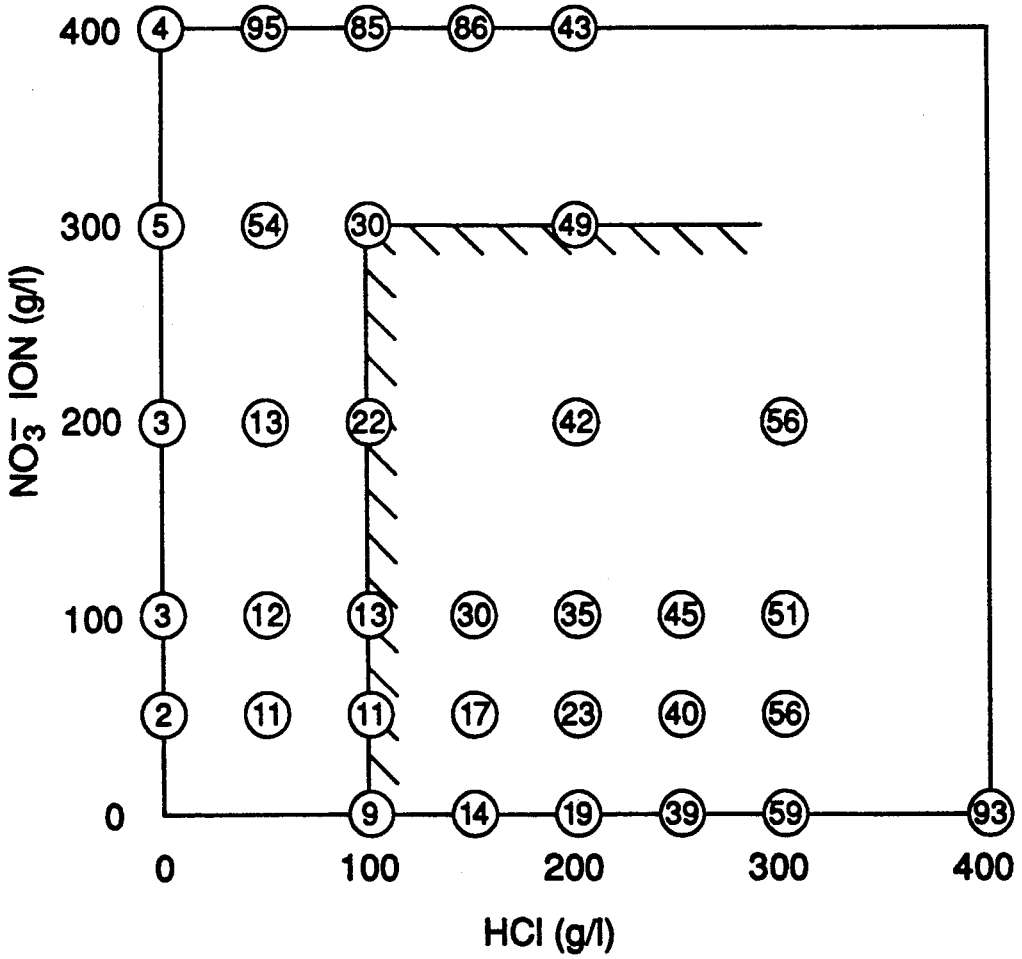
FIG. 2 is a diagram which illustrates the relationship between a concentration of an aqueous solution of hydrochloric acid containing a platinum ion in a quantity of 40 mg/l and a content of $NO_3^-$ion, when the steel strip of Type430 is dipped in the aqueous solution; the dissolving depth of the steel strip is shown using microns as the unit in the graph.
Figure 3:
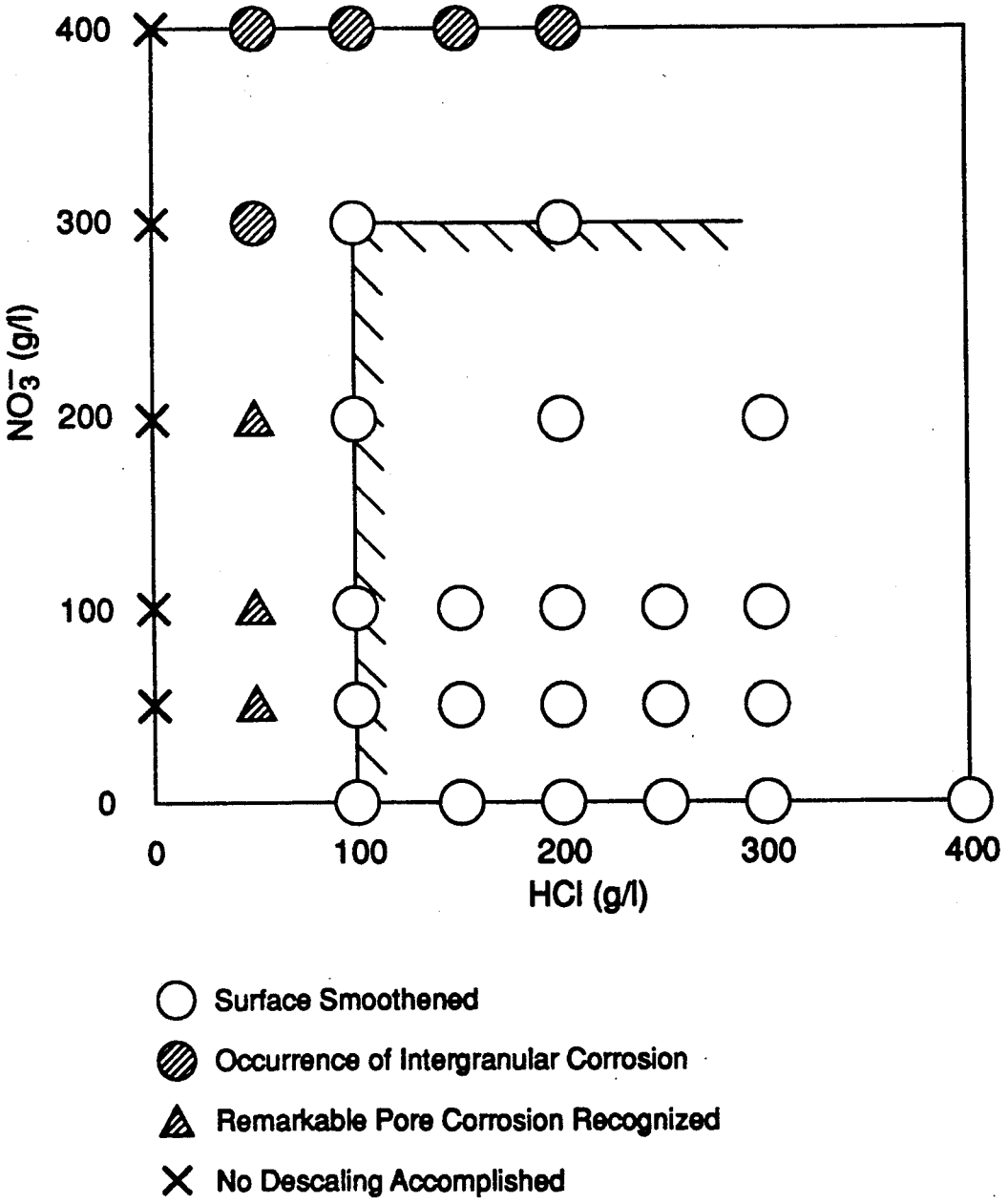
FIG. 3 is a graph which illustrates the relationship between a concentration of an aqueous solution of hydrochloric acid and a content of $NO_3^-$ion, particularly showing the surface state of the steel strip at dissolving locations.

In addition, when a nitric acid or a nitride such as $NaNO_3$ or the like is added to the aqueous solution of hydrochloric acid containing the platinum ion, the palladium ion and the rhodium ion, as a result, $NO_3^-$ion is contained in the aqueous solution, it has been found that the dissolving capability can be improved remarkably. In relation to this, FIG. 2 is a graph which illustrates the relationship between a concentration of an aqueous solution of hydrochloric acid containing a platinum ion by a quantity of 40 mg/l and a quantity of $NO_3^-$ion, particularly showing a dissolving quantity when $NO_3^-$ion is contained in the aqueous solution. As shown in the drawing, according to the amount by which the content of the $NO_3^-$ion and the concentration of hydrochloric acid in the aqueous solution increases, the quantity of corrosive scale removal increases correspondingly. However, as shown in FIG. 3, when the content of $NO_3^-$ion exceeds 300 g/l, there arises the problem of intergranular corrosion. For this reason, it is necessary that the content of $NO_3^-$ion is restrictively limited to 300 g/l or less.

Figure 4:
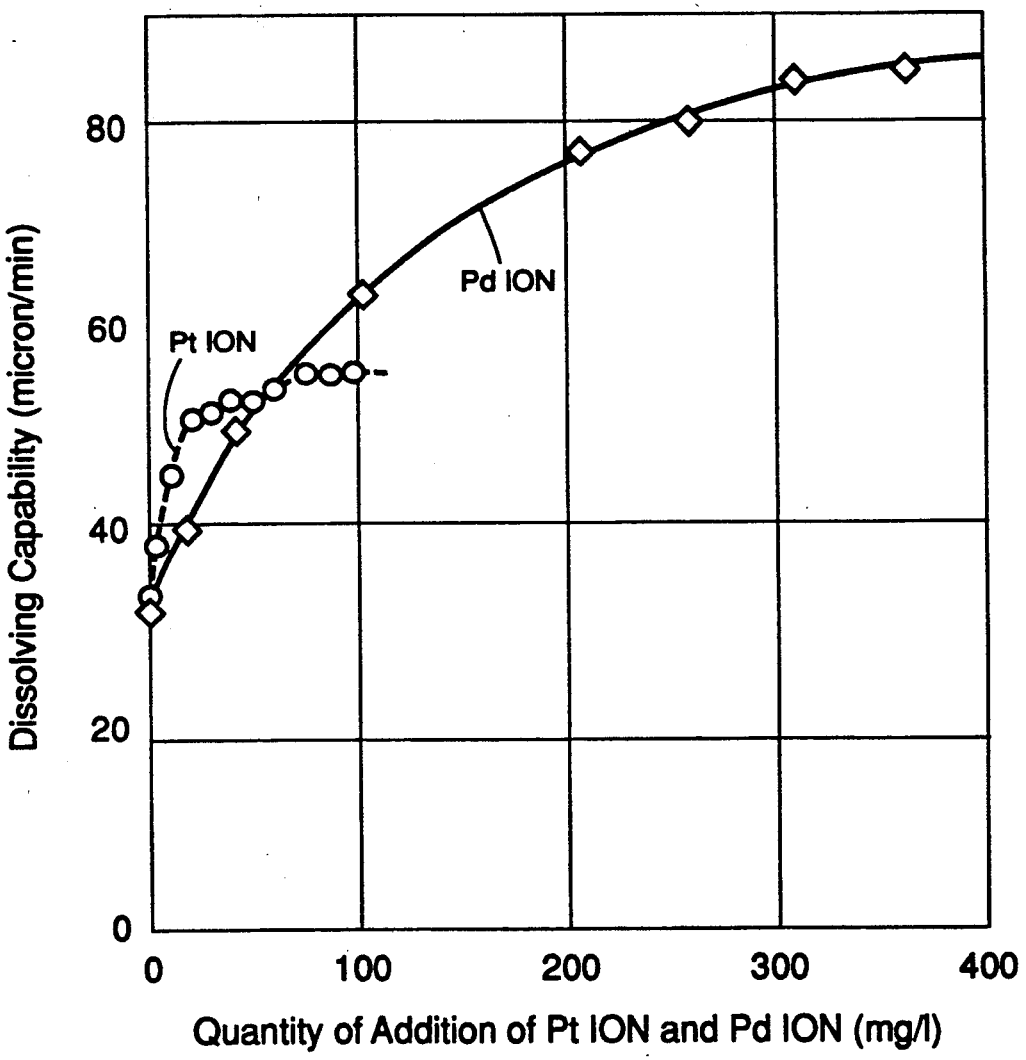
FIG. 4 is a graph which illustrates the relationship between a quantity of platinum ion and palladium ion added to an aqueous solution of a hydrochloric acid-nitric acid mixture and the dissolving capability of the aqueous solution when the steel strip of Type430 is dipped in the aqueous solution.

Next, FIG. 4 is a graph which illustrates a relationship between the quantity of additional platinum ions or a palladium ion and the dissolving capability, particularly showing the corrosive scale-removing ability in a case where the platinum ion or the palladium ion is individually added to an aqueous solution of hydrochloric acid-nitric mixture containing $NO_3^-$ion. As shown in the drawing, the dissolving capability is increased by addition of the platinum ion and the palladium ion without the possibility of the advantageous effects, as shown in FIG. 1, disappearing.

According to the present invention, the aqueous solution of a hydrochloric acid or hydrochloric acid-nitric acid mixture having a high dissolving capability is heated to a temperature of 50 to 110° C. so that a steel-based metallic material such as an ordinary steel, a low-alloy steel and a special steel containing a large quantity of chromium, nickel, molybdenum or the like, is dipped in or subjected to electrolytic treatment in the hot aqueous solution to remove scale formed on the surfaces of the metallic material by dissolving it in the aqueous solution. It should be added that the heating of the aqueous solution of hydrochloric acid or hydrochloric acid-nitric acid mixture as mentioned above is intended to corrosively remove the scale with high efficiency. Thus, the lower the temperature of the aqueous solution, the lower dissolving capability. On the contrary, the higher the temperature of the aqueous solution, the higher the dissolving capability. In the foregoing circumstances, the temperature of the aqueous solution is limited to a range of 50 to 110° C. in consideration of problems associated with the dipping time required for production on an industrial basis and a maintenance service for assuring safety of installations in a steel plant.

To perform electrolytic treatment, an electric current is fed between a coil of steel strip serving as an anode, and a cathode disposed opposite to the coil. Alternately, to perform electrolytic treatment, one or more pairs of electrode plates, each serving as an anode, and one or more pairs of electrode plates, each serving as a cathode, are arranged opposite to a surface of the steel-based metallic material to be treated in an aqueous solution of hydrochloric acid so that scale formed on the surfaces of the metallic material is corrosively removed by feeding a direct current between both the electrode plates. Although no specific definition is made with respect to an electric current density employable for the electrolytic treatment, it is preferable in consideration of effective and long-term corrosive scale removal, that the electric current density is limited to a range of 5 to 200 A/Dm$^2$, especially, when electrolytic treatment is performed at an electrical current density in excess of 200 A/Dm$^2$, the temperature of the aqueous solution is quickly elevated due to the electrical resistance of the aqueous solution itself. As a result, the quality of the aqueous solution of hydrochloric acid is substantially degraded. In addition, there is the possibility of the metallic material having an excessively overetched surface.

As is apparent from the above description, according to the present invention, after completion of each pickling treatment, a strip of steel sheet exhibits smooth surfaces without the occurrence of intergranular corrosion due to the Cr-depleted zone along the grain boundary. In addition, a low-alloy steel, a ferritic stainless steel, and an austenitic stainless steel containing nickel, each of which has been hitherto subjected to a pickling treatment by using a different aqueous solution in consideration of its dissolving capability, can be treated merely by using the same aqueous solution having a high dissolving capability employable for practicing the method of the present invention.

Next, the present invention will be described in more detail with reference to a few embodiment thereof.

EMBODIMENT 1

Table 1 shows the results obtained from a series of tests conducted for evaluating dissolving depth, dissolving capability per minute, and the presence or absence of intergranular corrosion with respect to the following case. Specifically, test samples were prepared such that hot-rolled coils of a low-chromium steel containing 7% chromium, a chromium-based stainless steel of Type 430 containing about 17% chromium, a high-chromium steel containing 19% chromium, an austenitic stainless steel of Type 304 containing 18% chromium and 8% nickel, a high-carbon steel containing 1.2% carbon and 0.4% chromium, and a chromium-molybdenum steel containing 17% chromium and 1% molybdenum, each having a width of 1 m and a weight of 10 ton, were not annealed but highly sensitized. In addition, other hot-rolled coils of the aforementioned kinds of steel were annealed for preparing test samples. Each of the test samples was subjected to mechanical descaling by blowing a high-pressure water containing granular ion sands toward a surface of the test sample to be treated. Subsequently, each test sample was dipped in an aqueous solution heated to specific temperature shown in the table, and thereafter, the test sample was subjected to a pickling treatment in an aqueous solution of hydrochloric acid having at least one kind of the selected from a group comprising a platinum ion, a palladium ion and a rhodium ion, added to a hydrochloric acid having a concentration of 100 to 50 g/l by a quantity of less than 500 mg/l or in an aqueous solution of a hydrochloric acid-nitric acid mixture with a nitric acid or a nitrate added to the first-mentioned aqueous solution, to contain $N_3^-$ion by a quantity of 0.5 to 300 g/l.

With the method of the present invention, each kind of steel-based metallic material exhibited a high dissolving speed. In addition, the efficiency of the descaling pickling treatment could be improved, and moreover, surfaces of the steel-based metallic material could be smoother by pickling treatment.

Subsequently, the strips of steel sheets treated in the above-described manner and comparative steel materials were cold-rolled by way of two steps of cold rolling, one of them being a step of cold rolling in a tandem cold roll mill including a series of mill stands each having a larger diameter roll (i.e., a work roll having a diameter of 200 to 600 mm) and the other one being a step of cold rolling in a Sendzmir mill having a smaller diameter roll (i.e., a work roll having a diameter of 100 mm or less) to a thickness of 3 to 0.4 mm. In addition, other steel strips and other comparative steel materials were cold-rolled to a thickness of 3 to 0.4 mm by way of a single step of cold rolling in the Sendzmir mill. After completion of the cold rolling operation, each of the steel strips and the comparative steel materials was subjected to bright annealing. Subsequently, each of products of steel strips and the comparative steel materials was tested with respect to the presence or absence of gold dust. As a result of the test, any formation of gold dust was not recognized on the steel strip, which had been treated with the method of the present invention while exhibiting excellent surface brightness. On the other hand, formation of gold dust was recognized on the comparative steel materials, each exhibiting intergranular corrosion.

EMBODIMENT 2

Figure 5A:
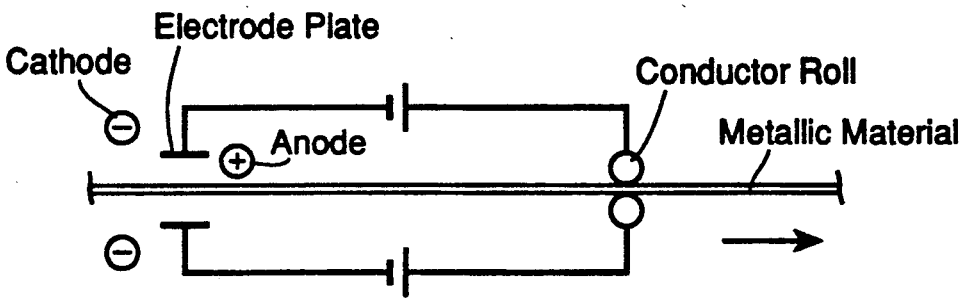
FIG. 5 (A) shows a direct electric current feeding process and FIG. 5 (B) shows an indirect electric current feeding process.
Figure 5B:
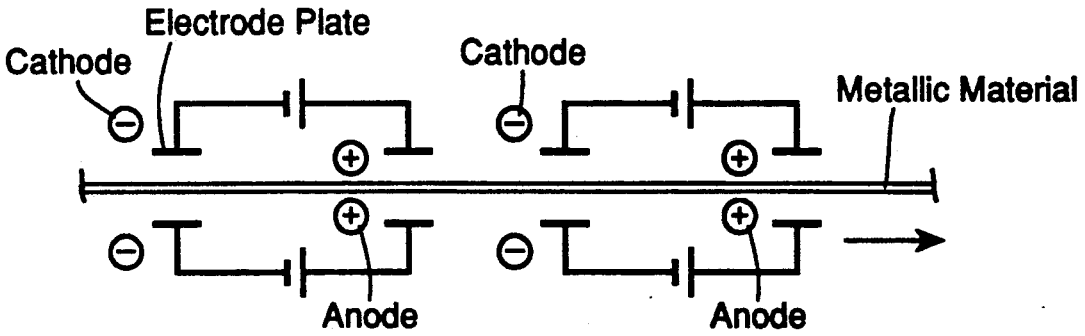

Table 2 shows the results obtained from a series of tests conducted for evaluating dissolving depth, dissolving capability per minute, and presence or absence of intergranular corrosion with respect to the following case. Specifically, test samples were prepared such that hot-rolled coils of a low-chromium steel containing 7% chromium, a chromium-based stainless steel of Type 430 containing about 16.5% chromium and an austenite-based stainless steel of Type 304 containing 18% chromium and 8% nickel, each having a width of 1.25 m and a weight of 11 ton, were not annealed but highly sensitized. In addition, other hot-rolled coils of the aforementioned kinds of steelwwere annealed for preparing test samples. Each of the test samples was subjected to mechanical descaling by blowing a high-pressure water containing granular iron sands toward a surface of the test sample to be treated. Then, each of the test samples was dipped in an aqueous solution of hydrochloric acid or an aqueous solution of hydrochloric acid-nitric acid mixture which was heated to a specific temperature shows in the table. At this time, at least one kind of the ion selected from a group comprising a platinum ion, a palladium ion and a rhodium ion, was added to the hydrochloric acid having a concentration of 100 to 450 g/l. As desired, a nitric acid or a nitrate was added to the hydrochloric acid containing a $NO_3^-$ion therein by a quantity of 0.5 to 300 g/l. Subsequently, a direct current was fed to the aqueous solution at an electric current density of 5 to 200 $A/Dm^2$ in accordance with a direct electric current feeding process or an indirect electric current feeding process. The direct electric current feeding process, as shown in FIG. 5 (A), was practiced such that each of the test samples served as an anode and a cathode was disposed opposite to the anode so as to feed a direct current between the test sample and the cathode. On the other hand, the indirect electric current feeding process, as shown in FIG. 5 (B), was practiced such that one pair of electrode plates (having a width of 1400 mm and a length of 400 mm), i.e., an anode and cathode, were located to one side of the surface of the test sample and other one pair of electrode plates were located symmetrically to other side of the surface of the test sample, and moreover, one pair of electrode plates having the same composition as the above were located symmetrically to both sides of the surface of the test sample, i.e., eight electrode plates in total were arranged in the aqueous solution in a vertically symmetrical relationship with respect to their polarity while maintaining a distance between the opposing pair of electrode plated, within the range of 30 to 100 mm. It should be noted that the test sample entered a pickling treatment bath from the inlet side and the eight electrode plates located on the above positions relative to the test sample in accordance with the polarity arrangement patterns as shown below (this pattern shown the polarities on only one side of the test sample), so as to feed an electric current between each of the anodes and cathode of electrode plates.

⊖ ⊕ ⊕ ⊖, ⊖ ⊕ ⊖ ⊕, ⊕ ⊖ ⊖ ⊕, ⊕ ⊖ ⊕ ⊖,
⊖ ⊕ ⊗ ⊗, ⊕ ⊖ ⊕ ⊕, ⊕ ⊖ ⊖ ⊕

(Note: ⊗ shows the polarity which does not feed the electric current)

With the method of the present invention, each kind of steel-based metallic material exhibited a high dissolving speed. In addition, a descaling pickling treatment efficiency could be improved, and surfaces of the steel-based metallic material could be smoother by a pickling treatment. The strips of steel sheets treated in the above-described manner were cold-rolled to a thickness of 4 to 0.4 mm by way of two steps of cold rolling, one of them being a step of cold rolling in a tandem cold mill including a series of mill stands, each having a larger diameter roll (i.e., a work roll having a diameter of 200 to 600 mm) and the other one being a step of cold rolling in a Sendzmir mill having a smaller diameter roll (i.e., a work having a diameter of 100 mm or less). In addition, other steel strips were cold-rolled to a thickness of 4 to 0.4 mm, by way of a single step of cold rolling in the Sendzmir mill. After completion of the cold rolling operation, each of the steel strips was subjected to bright annealing. Subsequently, each of the products of the steel strips was tested with respect to the presence or absence of gold dust. As a result of the test, formation of gold dust was not recognized on the steel strip which had been treated with the method of the present invention. The strip exhibited excellent surface brightness.

As described above, according to the present invention, since scale formed on surfaces of a steel-based metallic material can be removed at an improved dissolving efficiency, and moreover, the surfaces of the steel-based metallic material appearing after completion of the pickling treatment can be smoother, the process of the present invention offers many remarkably high-industrial advantageous effects.

TABLE 1

| metallic material | | pickling treatment conditions | | | | results | | | |
|---|---|---|---|---|---|---|---|---|---|
| kind of steel | annealing | concentration of pickling treatment solution | | temperature (°C.) | time (seconds) | dissolving depth (μm) | dissolving capability (μ/min) | recognition of intergranular corrosion | remark |
| low chromium steel | no | HCl 310 g/l $NaNO_3$ 75 g/l | Pd 30 mg/l | 80 | 120 | 20 | 10 | no | present |
| Type430 | no | HCl 310 g/l $NaNO_3$ 75 g/l | Pd 30 mg/l | 80 | 20 | 18 | 54 | no | invention |
| high chromium steel | yes | HCl 310 g/l $NaNO_3$ 75 g/l | Pd 30 mg/l | 80 | 10 | 28 | 168 | no | |
| Type304 | yes | HCl 310 g/l $NaNO_3$ 75 g/l | Pd 30 mg/l | 80 | 50 | 23 | 28 | no | |
| low chromium steel | yes | HCl 300 g/l | Pd 60 mg/l | 80 | 90 | 21 | 14 | no | |
| Type430 | yes | HCl 450 g/l | Pd 60 mg/l | 80 | 15 | 23 | 90 | no | |
| high chromium steel | yes | HCl 100 g/l | Pd 60 mg/l | 80 | 60 | 16 | 16 | no | |
| Type304 | yes | HCl 300 g/l | Pd 60 mg/l | 80 | 60 | 18 | 18 | no | |
| Type304 | yes | HCl 300 g/l | Pd 60 mg/l | 80 | 300 | 88 | 18 | no | |
| low chromium steel | no | $H_2SO_4$ 300 g/l | | 90 | 180 | 12 | 4 | — | comparative example |
| Type430 | no | $H_2SO_4$ 300 g/l | | 90 | 60 | 12 | 12 | no | |
| Type304 | no | $H_2SO_4$ 300 g/l | | 90 | 600 | 10 | 1 | — | |
| high chromium steel | no | $H_2SO_4$ 300 g/l | | 90 | 180 | 12 | 4 | — | |
| Type304 | no | $HNO_3$ 130 g/l HF30 g/l | | 70 | 200 | 10 | 3 | no | |
| Type430 | no | $HNO_3$ 130 g/l HF30 g/l | | 70 | 60 | 14 | 14 | yes | |
| Type430 | no | HCl 50 g/l $HNO_3$ 300 g/l | Pd 30 mg/l | 80 | 20 | 17 | 51 | yes | |
| Type430 | no | HCl 200 g/l $HNO_3$ 400 g/l | Pd 30 mg/l | 80 | 20 | 18 | 54 | yes | |
| ordinary steel | no | HCl 300 g/l $NaNO_3$ 55 g/l | Pd 30 mg/l | 80 | 150 | 20 | 8 | — | present |
| ordinary steel | no | HCl 300 g/l | Pd 60 mg/l | 80 | 300 | 70 | 14 | — | invention |
| Cr—Mo Steel | no | HCl 300 g/l $NaNO_3$ 55 g/l | Pd 30 mg/l | 80 | 60 | 20 | 20 | — | |
| Cr—Mo Steel | no | HCl 300 g/l | Pd 60 mg/l | 80 | 200 | 20 | 6 | — | |
| Type430 | no | HCl 300 g/l $HNO_3$ 0.5 g/l | Pd 60 mg/l | 80 | 60 | 70 | 70 | no | present |
| Type430 | no | HCl 100 g/l $HNO_3$ 100 g/l | Pd 450 mg/l | 80 | 60 | 28 | 28 | no | invention |
| Type430 | no | HCl 200 g/l $HNO_3$ 300 g/l | Pd 450 mg/l | 80 | 20 | 33 | 99 | no | |
| Type430 | no | HCl 450 g/l $HNO_3$ 50 g/l | Pd 500 mg/l | 80 | 20 | 60 | 180 | no | |
| ordinary steel | no | HCl 6% | | 85 | 300 | 5 | 1 | — | comparative |
| Cr—Mo steel | no | $H_2SO_4$ 300 g/l | | 90 | 360 | 12 | 2 | — | |

TABLE 1-continued

| metallic material | | pickling treatment conditions | | | | results | | | |
|---|---|---|---|---|---|---|---|---|---|
| kind of steel | annealing | concentration of pickling treatment solution | | temperature (°C.) | time (seconds) | dissolving depth (μm) | dissolving capability (μ/min) | recognition of intergranular corrosion | remark |
| Cr—Mo steel | no | $HNO_3$ 135 g/l HF35 g/l | | 70 | 180 | 12 | 4 | no | example |
| low chromium steel | no | HCl 310 g/l $HNO_3$ 55 g/l | Pd 30 mg/l | 110 | 60 | 50 | 50 | no | present |
| Type430 | no | HCl 310 g/l $HNO_3$ 55 g/l | Pd 30 mg/l | 50 | 150 | 20 | 8 | no | invention |
| high chromium steel | yes | HCl 310 g/l $HNO_3$ 55 g/l | Pd 30 mg/l | 50 | 60 | 24 | 24 | no | |
| Type304 | yes | HCl 310 g/l $HNO_3$ 55 g/l | Pd 30 mg/l | 90 | 30 | 24 | 48 | no | |
| low chromium steel | yes | HCl 300 g/l | Pd 60 mg/l | 110 | 20 | 23 | 69 | no | |
| Type430 | yes | HCl 300 g/l | Pd 60 mg/l | 50 | 120 | 18 | 9 | no | |
| high chromium steel | yes | HCl 300 g/l | Pd 60 mg/l | 50 | 60 | 15 | 15 | no | |
| Type304 | yes | HCl 300 g/l | Pd 60 mg/l | 110 | 20 | 30 | 90 | no | |
| ordinary steel | no | HCl 300 g/l $HNO_3$ 40 g/l | Pd 30 mg/l | 110 | 30 | 20 | 40 | — | |
| ordinary steel | no | HCl 300 g/l | Pd 60 mg/l | 90 | 60 | 25 | 25 | — | |
| Cr—Mo steel | no | HCl 300 g/l $HNO_3$ 40 g/l | Pd 30 mg/l | 90 | 20 | 12 | 36 | — | |
| Cr—Mo steel | no | HCl 300 g/l | Pt 5 mg/l<br>Pd 10 mg/l<br>Rh 15 mg/l | 80 | 200 | 20 | 6 | — | |
| low chromium steel | no | HCl 310 g/l $NaNO_3$ 75 g/l | Pd 500 mg/l | 80 | 120 | 31 | 16 | no | |
| Type430 | no | HCl 310 g/l $NaNO_3$ 75 g/l | Pd 200 mg/l | 80 | 20 | 24 | 72 | no | |
| high chromium steel | yes | HCl 310 g/l $NaNO_3$ 75 g/l | Pt 50 mg/l<br>Rh 150 mg/l | 80 | 10 | 38 | 228 | no | |
| Type304 | yes | HCl 310 g/l $NaNO_3$ 75 g/l | Pt 50 mg/l<br>Pd 150 mg/l | 80 | 50 | 31 | 37 | no | |
| Type430 | yes | HCl 300 g/l | Pt 30 mg/l<br>Pd 70 mg/l<br>Rh 100 mg/l | 80 | 20 | 27 | 81 | no | |

(note) Pd, Pt and Rh in the table represent Pd ion, Pt ion and Rh ion.

TABLE 2

| metallic material | | pickling treatment conditions | | | | | | | results | | |
|---|---|---|---|---|---|---|---|---|---|---|---|
| kind of steel | annealing | concentration of pickling treatment solution | | feeding of electric current | arrangement of polarity | electric current density ($A/Dm^2$) | temperature (°C.) | time (seconds) | dissolving depth (μm) | dissolving capability (μ/min) | recognition of intergranular corrosion |
| low chromium steel | no | HCl 310 g/l<br>$HNO_3$ 45 g/l | Pt 40 mg/l | direct | + | 80 | 80 | 60 | 15 | 15 | no |
| Type430 | no | HCl 310 g/l<br>$HNO_3$ 45 g/l | Pt 40 mg/l | direct | + | 80 | 80 | 20 | 21 | 63 | no |
| Type304 | no | HCl 310 g/l<br>$HNO_3$ 45 g/l | Pt 40 mg/l | direct | + | 80 | 80 | 60 | 35 | 35 | no |
| low chromium steel | no | HCl 305 g/l | Pd 200 mg/l | direct | + | 80 | 80 | 60 | 27 | 27 | no |
| Type430 | no | HCl 305 g/l | Pd 200 mg/l | direct | + | 80 | 80 | 10 | 16 | 96 | no |
| Type304 | no | HCl 305 g/l | Pd 200 mg/l | direct | + | 80 | 80 | 60 | 34 | 34 | no |
| low chromium steel | no | HCl 450 g/l<br>$HNO_3$ 0.5 g/l | Rh 200 mg/l | indirect | −+ | 160 | 80 | 60 | 33 | 33 | no |
| Type430 | no | HCl 450 g/l<br>$HNO_3$ 20 g/l | Rh 200 mg/l | indirect | −+ | 160 | 80 | 20 | 42 | 126 | no |
| Type304 | no | HCl 400 g/l<br>$HNO_3$ 20 g/l | Rh 200 mg/l | indirect | −++− | 160 | 80 | 30 | 37 | 73 | no |
| low chromium steel | no | HCl 450 g/l | Pt 40 mg/l | indirect | −++− | 160 | 80 | 60 | 28 | 28 | no |
| Type430 | no | HCl 450 g/l | Pt 40 mg/l | indirect | −++− | 160 | 80 | 20 | 33 | 99 | no |
| Type304 | no | HCl 400 g/l | Pt 40 mg/l | indirect | −++− | 160 | 80 | 60 | 38 | 38 | no |
| low chromium steel | no | HCl 310 g/l<br>$NaNO_3$ 45 g/l | Pt 10 mg/l | indirect | −+−+ | 160 | 80 | 60 | 15 | 15 | no |
| Type430 | no | HCl 310 g/l<br>$NaNO_3$ 45 g/l | Pt 10 mg/l | indirect | −+−+ | 160 | 80 | 60 | 54 | 54 | no |
| Type304 | no | HCl 310 g/l<br>$NaNO_3$ 45 g/l | Pt 10 mg/l | indirect | −+−+ | 160 | 80 | 60 | 30 | 30 | no |
| low chromium steel | no | HCl 305 g/l | Pt 50 mg/l | indirect | −+−+ | 55 | 80 | 60 | 22 | 22 | no |
| Type430 | no | HCl 305 g/l | Pt 50 mg/l | indirect | −+−+ | 55 | 80 | 20 | 25 | 75 | no |
| Type304 | no | HCl 305 g/l | Pt 50 mg/l | indirect | −+−+ | 55 | 80 | 60 | 30 | 30 | no |
| low chromium steel | no | HCl 100 g/l<br>$HNO_3$ 300 g/l | Pt 40 mg/l | indirect | +− | 100 | 80 | 60 | 9 | 9 | no |
| Type430 | no | HCl 100 g/l<br>$HNO_3$ 300 g/l | Pt 40 mg/l | indirect | +− | 100 | 80 | 60 | 30 | 30 | no |
| Type304 | no | HCl 100 g/l<br>$HNO_3$ 300 g/l | Pt 40 mg/l | indirect | +−− | 100 | 80 | 60 | 18 | 18 | no |
| low chromium steel | no | HCl 100 g/l | Pd 40 mg/l | indirect | +−−+ | 100 | 80 | 300 | 15 | 3 | no |
| Type430 | no | HCl 100 g/l | Pd 40 mg/l | indirect | +−−+ | 100 | 80 | 60 | 9 | 9 | no |
| Type304 | no | HCl 100 g/l | Pd 40 mg/l | indirect | +−−+ | 100 | 80 | 300 | 15 | 3 | no |

TABLE 2-continued

| metallic material | | pickling treatment conditions | | | | | | | results | | |
|---|---|---|---|---|---|---|---|---|---|---|---|
| kind of steel | annealing | concentration of pickling treatment solution | | feeding of electric current | arrangement of polarity | electric current density ($A/Dm^2$) | temperature (°C.) | time (seconds) | dissolving depth (μm) | dissolving capability (μ/min) | recognition of intergranular corrosion |
| low chromium steel | no | HCl 310 g/l<br>$HNO_3$ 45 g/l | Pd 40 mg/l | indirect | +−+− | 100 | 80 | 60 | 19 | 19 | no |
| Type430 | no | HCl 310 g/l<br>$HNO_3$ 45 g/l | Pd 450 mg/l | indirect | +−+− | 100 | 80 | 20 | 33 | 99 | no |
| Type304 | no | HCl 310 g/l<br>$HNO_3$ 45 g/l | Pd 500 mg/l | indirect | +−+− | 100 | 80 | 20 | 20 | 60 | no |
| low chromium steel | yes | HCl 305 g/l | Pt 40 mg/l | indirect | +−+− | 200 | 80 | 60 | 22 | 22 | no |
| Type430 | yes | HCl 305 g/l | Pt 40 mg/l | indirect | +−+− | 200 | 80 | 20 | 24 | 72 | no |
| Type304 | yes | HCl 305 g/l | Pt 40 mg/l | indirect | +−+− | 200 | 80 | 60 | 22 | 22 | no |
| Type430 | yes | HCl 310 g/l<br>$HNO_3$ 45 g/l | Pt 40 mg/l | indirect | −++− | 5 | 80 | 60 | 68 | 68 | no |
| Type430 | no | HCl 300 g/l<br>$HNO_3$ 55 g/l | Pt 30 mg/l<br>Pd 70 mg/l<br>Rh 100 mg/l | indirect | +−+− | 80 | 80 | 20 | 27 | 81 | no |
| low chromium steel | no | HCl 310 g/l<br>$HNO_3$ 45 g/l | Pt 40 mg/l | indirect | −++− | 86 | 50 | 300 | 10 | 2 | no |
| Type430 | no | HCl 310 g/l<br>$HNO_3$ 45 g/l | Pt 40 mg/l | direct | −++− | 86 | 50 | 60 | 10 | 10 | no |
| Type304 | no | HCl 310 g/l<br>$HNO_3$ 45 g/l | Pt 40 mg/l | direct | −++− | 86 | 50 | 120 | 10 | 5 | no |
| low chromium steel | no | HCl 305 g/l | Pt 80 mg/l | indirect | −++− | 86 | 50 | 240 | 12 | 3 | no |
| Type430 | no | HCl 305 g/l | Pt 80 mg/l | indirect | −++− | 86 | 50 | 60 | 11 | 11 | no |
| Type304 | no | HCl 305 g/l | Pt 80 mg/l | indirect | −++− | 86 | 50 | 240 | 16 | 4 | no |
| low chromium steel | no | HCl 310 g/l<br>$HNO_3$ 45 g/l | Pt 40 mg/l | indirect | −+−+ | 86 | 110 | 20 | 30 | 90 | no |
| Type430 | no | HCl 310 g/l<br>$HNO_3$ 45 g/l | Pt 40 mg/l | indirect | −+−+ | 86 | 110 | 10 | 54 | 324 | no |
| Type304 | no | HCl 310 g/l<br>$HNO_3$ 45 g/l | Pt 40 mg/l | indirect | −+−+ | 86 | 110 | 15 | 46 | 184 | no |
| low chromium steel | no | HCl 305 g/l | Pt 40 mg/l | indirect | −+−+ | 86 | 110 | 20 | 37 | 111 | no |
| Type430 | no | HCl 305 g/l | Pt 40 mg/l | indirect | −+−+ | 86 | 110 | 10 | 63 | 378 | no |
| Type304 | no | HCl 305 g/l | Pt 40 mg/l | indirect | −+−+ | 86 | 110 | 20 | 50 | 150 | no |

(note) Pd, Pt and Rh in the table represent Pd ion, Pt ion and Rh ion.

We claim:

1. A process for pickling a steel-based metallic material at a high speed comprising: dipping said metallic material in or subjecting to electrolytic treatment in an aqueous solution of hydrochloric acid which contains at least one kind of the ion selected from a group comprising a platinum ion, a palladium ion and a rhodium ion by a quantity of 500 mg/l or less, in a hydrochloric acid having a concentration of 100 to 450 g/l and of which temperature is elevated to a range of 50 to 110° C.

2. The process according to claim 1, further comprising accomplishing said electrolytic treatment by feeding a direct current between two electrodes at an electric current density of 5 to 200 $A/Dm^2$, one of said electrodes being an anode composed of said metallic material and the other one being a cathode electrode disposed opposite to said anode.

3. The process according to claim 1, further comprising accomplishing said electrolytic treatment by feeding a direct current between two electrodes consisting of an anode in parallel to a cathode at an electric current density of 5 to 200 $A/Dm^2$, said electrodes being disposed near to a surface of one side of said metallic material, whereby dissolving off a scale formed on said surface of said metallic material in said aqueous solution by indirect feeding of said direct current.

4. The process according to claim 1, further comprising accomplishing said electrolytic treatment by feeding a direct current between two electrodes consisting of an anode in parallel to a cathode at an electric current density of 5 to 200 $A/Dm^2$, said two electrodes being disposed near to a surface of one side of the metallic material and two other electrodes having the same composition as the above two electrodes being symmetrically disposed near to an opposite surface of the metallic material, whereby a dissolving off of a scale formed on the both surfaces of the metallic material in the aqueous solution is achieved by an indirect feeding of the direct current.

5. The process according to claim 4, further comprising creating a plurality of said two electrodes on both surfaces of the metallic material.

6. A process for pickling a steel-based metallic material at a high speed comprising: dipping said metallic material in or subjecting to electrolytic treatment in an aqueous solution of hydrochloric acid having a concentration of 100 to 450 g/l which contains an $NO_3^-$ion of 300 g/l or less and at least one kind of the ion selected from a group comprising a platinum ion, a palladium ion and a rhodium ion of 500 mg/l or less and of which temperature is elevated to a range of 50 to 110° C.

7. The process according to claim 6, further comprising said aqueous solution of hydrochloric acid having a concentration of 100 to 450 g/l containing $NO_3^-$ion of 300 g/l or less by adding a nitric acid or a nitrate thereto.

8. The process according to claim 6, further comprising accomplishing said electrolytic treatment by feeding a direct current between two electrodes at an electric current density of 5 to 200 $A/Dm^2$, one of said electrodes being an anode composed of said metallic material and the other one being a cathode electrode disposed opposite to said anode.

9. The process according to claim 6, further comprising accomplishing said electrolytic treatment by feeding a direct current between two electrodes consisting of an anode in parallel to a cathode at an electric current density of 5 to 200 A/Dm$^2$, said electrodes being disposed near to a surface of one side of said metallic material, whereby dissolving off a scale formed on said surface of said metallic material in said aqueous solution by an indirect feeding of said direct current.

10. The process according to claim 6, further comprising accomplishing said electrolytic treatment by feeding a direct current between two electrodes consisting of an anode in parallel to a cathode at an electric current density of 5 to 200 A/Dm$^2$, said two electrodes being disposed near to a surface of one side of the metallic material and two other electrodes having the same composition as the above two electrodes being symmetrically disposed near to an opposite surface of the metallic material, whereby a dissolving off of a scale formed on the both surfaces of the metallic material in the aqueous solution is achieved by an indirect feeding of the direct current.

11. The process according to claim 10, further comprising creating a plurality of said two electrodes on both surfaces of the metallic material.

12. The process according to claim 1 or 6, wherein said steel-based metallic material is a carbon steel, a low-alloy steel or a special steel.

* * * * *